US008940466B2

(12) United States Patent
Bellino et al.

(10) Patent No.: US 8,940,466 B2
(45) Date of Patent: Jan. 27, 2015

(54) PHOTO CONDUCTOR OVERCOAT COMPRISING RADICAL POLYMERIZABLE CHARGE TRANSPORT MOLECULES AND HEXA-FUNCTIONAL URETHANE ACRYLATES

(71) Applicant: Lexmark International, Inc., Lexington, KY (US)

(72) Inventors: Mark Thomas Bellino, Loveland, CO (US); David Glen Black, Broomfield, CO (US); Weimei Luo, Louisville, CO (US); Scott Daniel Reeves, Louisville, CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/731,594

(22) Filed: Dec. 31, 2012

(65) Prior Publication Data

US 2014/0186758 A1 Jul. 3, 2014

(51) Int. Cl.
*G03G 5/00* (2006.01)
*G03G 5/147* (2006.01)

(52) U.S. Cl.
CPC ..... *G03G 5/14769* (2013.01); *G03G 5/14734* (2013.01); *G03G 5/14786* (2013.01); *G03G 5/14791* (2013.01)
USPC ..... 430/66

(58) Field of Classification Search
CPC ..... G03G 5/14769; G03G 5/14734
USPC ..... 430/66
See application file for complete search history.

(56) References Cited

U.S. PATENT DOCUMENTS

| | | | | |
|---|---|---|---|---|
| 4,092,173 | A * | 5/1978 | Novak et al. | 430/531 |
| 5,545,499 | A | 8/1996 | Balthis | |
| 5,925,486 | A | 7/1999 | Levin | |
| 6,001,523 | A | 12/1999 | Kemmesat | |
| 6,004,708 | A | 12/1999 | Bellino | |
| 6,033,816 | A | 3/2000 | Luo | |
| 6,071,660 | A | 6/2000 | Black | |
| 6,232,025 | B1 | 5/2001 | Srinivasan | |
| 6,265,124 | B1 | 7/2001 | Luo | |
| 6,376,143 | B1 | 4/2002 | Neely | |
| 7,358,017 | B2 | 4/2008 | Reeves | |
| 7,387,861 | B2 | 6/2008 | Black | |
| 7,390,602 | B2 | 6/2008 | Reeves | |
| 7,642,027 | B2 | 1/2010 | Hartman | |
| 7,955,769 | B2 | 6/2011 | Black | |
| 8,257,889 | B2 | 9/2012 | Cote | |
| 2007/0134570 | A1 | 6/2007 | Hartman | |
| 2011/0111335 | A1 * | 5/2011 | Shimoyama et al. | 430/60 |

* cited by examiner

*Primary Examiner* — Mark A Chapman

(57) ABSTRACT

An overcoat layer for an organic photoconductor drum of an electrophotographic image forming device is provided. The overcoat layer is prepared from an (UV) ultraviolet curable composition including a urethane resin having at least six radical polymerizable functional groups and a charge transport molecule having at least one radical polymerizable functional group. The amount of the urethane resin having at least six radical polymerizable functional groups in the curable composition is about 35 percent to about 65 percent by weight. The amount of the charge transport molecules having at least one radical polymerizable functional group in the curable composition is about 35 percent to about 65 percent by weight. This overcoat layer improves wear resistance of the organic photoconductor drum without negatively altering the electrophotographic properties, thus protecting the organic photoconductor drum from damage and extending its useful life.

18 Claims, 2 Drawing Sheets

PHOTO CONDUCTOR OVERCOAT COMPRISING RADICAL POLYMERIZABLE CHARGE TRANSPORT MOLECULES AND HEXA-FUNCTIONAL URETHANE ACRYLATES

CROSS REFERENCES TO RELATED APPLICATIONS

None.

BACKGROUND

1. Field of the Disclosure

The present disclosure relates generally to electrophotographic image forming devices, and more particularly to an overcoat layer for an organic photoconductor drum having excellent abrasion resistance and electrical properties.

2. Description of the Related Art

Organic photoconductor drums have generally replaced inorganic photoconductor drums in electrophotographic image forming device including copiers, facsimiles and laser printers due to their superior performance and numerous advantages compared to inorganic photoconductors. These advantages include improved optical properties such as having a wide range of light absorbing wavelengths, improved electrical properties such as having high sensitivity and stable chargeability, availability of materials, good manufacturability, low cost, and low toxicity.

While the above enumerated performance and advantages exhibited by an organic photoconductor drums are significant, inorganic photoconductor drums traditionally exhibit much higher durability—thereby resulting in a photoconductor having a desirable longer life. Inorganic photoconductor drums (e.g., amorphous silicon photoconductor drums) are ceramic-based, thus are extremely hard and abrasion resistant. Conversely, the surface of an organic photoconductor drums is typically comprised of a low molecular weight charge transport material, and an inert polymeric binder and are susceptible to scratches and abrasions. Therefore, the drawback of using organic photoconductor drums typically arises from mechanical abrasion of the surface layer of the photoconductor drum due to repeated use. Abrasion of photoconductor drum surface may arise from its interaction with print media (e.g. paper), paper dust, or other components of the electrophotographic image forming device such as the cleaner blade or charge roll. The abrasion of photoconductor drum surface degrades its electrical properties, such as sensitivity and charging properties. Electrical degradation results in poor image quality, such as lower optical density, and background fouling. When a photoconductor drum is locally abraded, images often have black toner bands due to the inability to hold charge in the thinner regions. This black banding on the print media often marks the end of the life of the photoconductor drum, thereby causing the owner of the printer with no choice but to purchase another expensive photoconductor drum. Photoconductor drum lives in the industry are extremely variable. Usually organic photoconductor drums can print between about 40,000 pages before they have to be replaced.

Increasing the life of the photoconductor drum will allow the photoconductor drum to become a permanent part of the electrophotographic image forming device. In other words, the photoconductor drum will no longer be a replaceable unit nor be viewed as a consumable item that has to be purchased multiple times by the owner of the ep printer. Photoconductor drums having an 'ultra long life' allow the printer to operate with a lower cost-per-page, more stable image quality, and less waste leading to a greater customer satisfaction with his or her printing experience. A photoconductor drum having an ultra ling life can be defined as a photoconductor drum having the ability to print at a minimum 100,000 pages before the consumer has to purchase a replacement photoconductor drum.

To achieve a long life photoconductor drum, especially with organic photoconductor drum, a protective overcoat layer may be coated onto the surface of the photoconductor drum. An overcoat layer formed from a silicon material has been known to improve life of the photoconductor drums used for color printers. However, such overcoat layer does not have the robustness for edge wear of photoconductor drums used in mono (black ink only) printers. A robust overcoat layer that improves wear resistance and extends life of photoconductor drums for both mono and color printers is desired.

Some overcoats are known to extend the life of the photoconductor drums. However one major drawback of these overcoats is that they significantly alter the electrophotographic properties of the photoconductor drum in a negative way. If the overcoat layer is too electrically insulating, the photoconductor drum will not discharge and will result in a poor latent image. On the other hand, if the overcoat layer is too electrically conducting, then the electrostatic latent image will spread resulting in a blurred image. Thus, a protective overcoat layer that extends the life of the photoconductor drum must not negatively alter the electrophotographic properties of the photoconductor drum, thereby allowing sufficient charge migration through the overcoat layer to the photoconductor surface for adequate development of the latent image with toner.

SUMMARY

The present disclosure provides an overcoat layer for an organic photoconductor drum of an electrophotographic image forming device. The overcoat layer is prepared from an ultraviolet (UV) curable composition including a urethane resin having at least six radical polymerizable functional groups and a charge transport molecule having at least one radical polymerizable functional group. The amount of the urethane resin having at least six radical polymerizable functional groups in the curable composition is about 35 percent to about 65 percent by weight. The amount of the charge transport molecule having at least one radical polymerizable functional group in the curable composition is about 35 percent to about 65 percent by weight. This overcoat layer of the present invention improves the wear resistance of the organic photoconductor drum while simultaneously allowing the charge migration to successfully generate from the photoconductor drum. Therefore, this overcoat layer ultimately allows the successful printing of over 100,000 pages by the image forming device before it has to be replaced by the consumer.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

Figure 1:
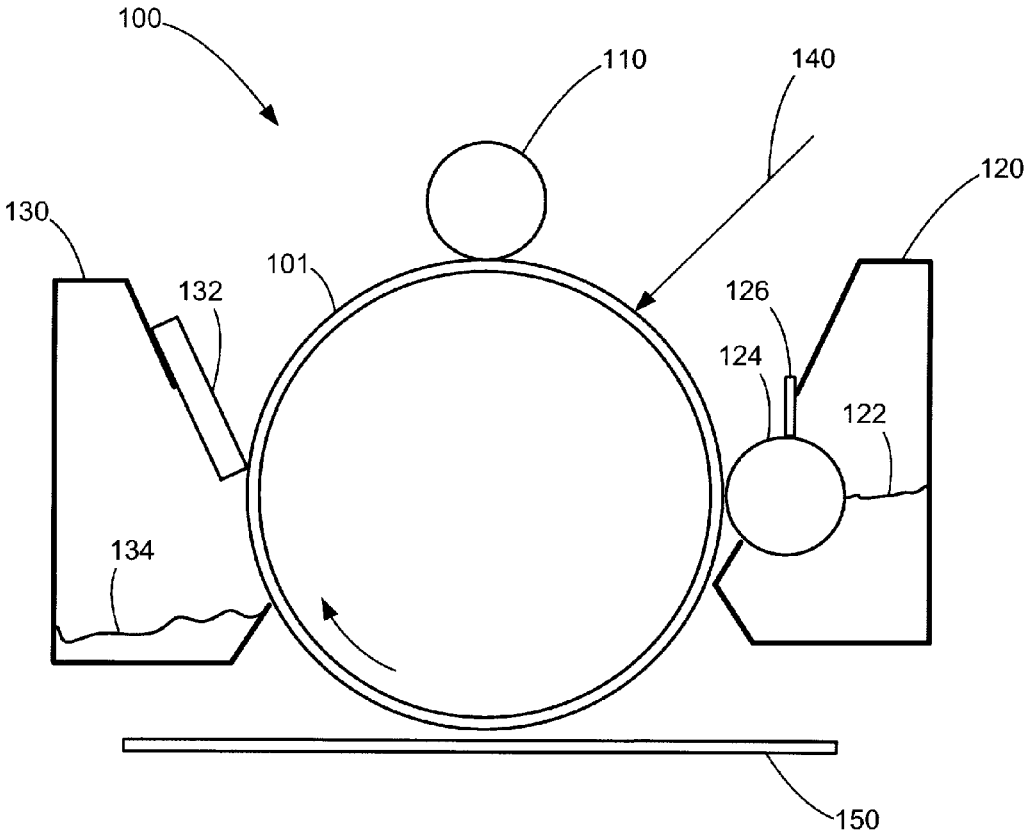
FIG. 1 is a schematic view of an electrophotographic image forming device.

It is to be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

FIG. 1 illustrates a schematic representation of an example electrophotographic image forming device 100. Image forming device 100 includes a photoconductor drum 101, a charge roll 110, a developer unit 120, and a cleaner unit 130. The electrophotographic printing process is well known in the art and, therefore, is described briefly herein. During a print operation, charge roll 110 charges the surface of photoconductor drum 101. The charged surface of photoconductor drum 101 is then selectively exposed to a laser light source 140 to form an electrostatic latent image on photoconductor drum 101 corresponding to the image being printed. Charged toner from developer unit 120 is picked up by the latent image on photoconductor drum 101 creating a toned image.

Developer unit 120 includes a toner sump 122 having toner particles stored therein and a developer roll 124 that supplies toner from toner sump 122 to photoconductor drum 101. Developer roll 124 is electrically charged and electrostatically attracts the toner particles from toner sump 122. A doctor blade 126 disposed along developer roll 124 provides a substantially uniform layer of toner on developer roll 124 for subsequent transfer to photoconductor drum 101. As developer roll 124 and photoconductor drum 101 rotate, toner particles are electrostatically transferred from developer roll 124 to the latent image on photoconductor drum 101 forming a toned image on the surface of photoconductor drum 101. In one embodiment, developer roll 124 and photoconductor drum 101 rotate in the same rotational direction such that their adjacent surfaces move in opposite directions to facilitate the transfer of toner from developer roll 124 to photoconductor drum 101. A toner adder roll (not shown) may also be provided to supply toner from toner sump 122 to developer roll 124. Further, one or more agitators (not shown) may be provided in toner sump 122 to distribute the toner therein and to break up any clumped toner.

The toned image is then transferred from photoconductor drum 101 to print media 150 (e.g., paper) either directly by photoconductor drum 101 or indirectly by an intermediate transfer member. A fusing unit (not shown) fuses the toner to print media 150. A cleaning blade 132 (or cleaning roll) of cleaner unit 130 removes any residual toner adhering to photoconductor drum 101 after the toner is transferred to print media 150. Waste toner from cleaning blade 132 is held in a waste toner sump 134 in cleaning unit 130. The cleaned surface of photoconductor drum 101 is then ready to be charged again and exposed to laser light source 140 to continue the printing cycle.

The components of image forming device 100 are replaceable as desired. For example, in one embodiment, developer unit 120 is housed in a replaceable unit with photoconductor drum 101, cleaner unit 130 and the main toner supply of image forming device 100. In another embodiment, developer unit 120 is provided with photoconductor drum 101 and cleaner unit 130 in a first replaceable unit while the main toner supply of image forming device 100 is housed in a second replaceable unit. In another embodiment, developer unit 120 is provided with the main toner supply of image forming device 100 in a first replaceable unit and photoconductor drum 101 and cleaner unit 130 are provided in a second replaceable unit. Further, any other combination of replaceable units may be used as desired. In some example embodiment, the photoconductor drum 101 may not be replaced and is a permanent component of the image forming device 100.

Figure 2:
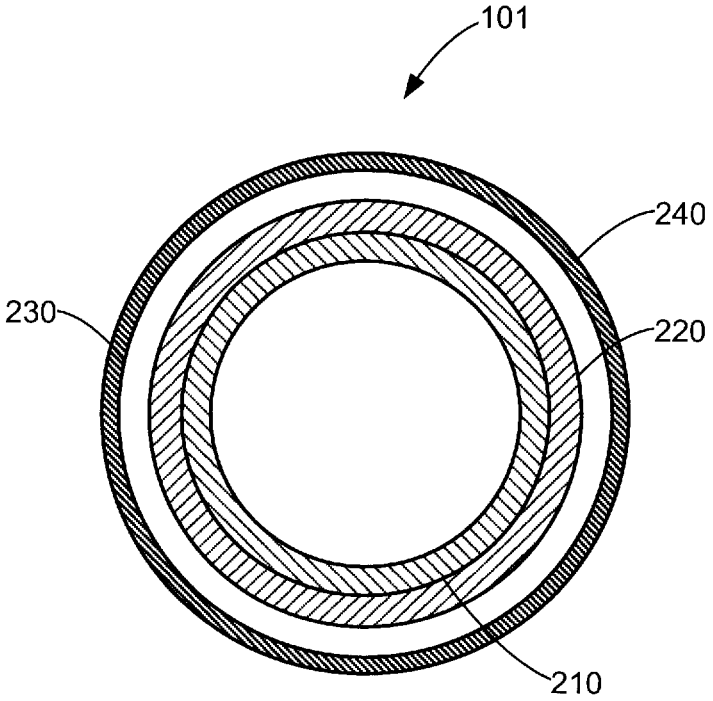
FIG. 2 is a cross-sectional view of a photoconductor drum of the electrophotographic image forming device.

FIG. 2 illustrates an example photoconductor drum 101 in more detail. In this example embodiment, the photoconductor drum 101 is an organic photoconductor drum and includes a support element 210, a charge generation layer 220 disposed over the support element 210, a charge transport layer 230 disposed over the charge generation layer 220, and a protective overcoat layer 240 formed as an outermost layer of the photoconductor drum 101. Additional layers may be included between the support element 210, the charge generation layer 220 and the charge transport layer 230, including adhesive and/or coating layers.

The support element 210 as illustrated in FIG. 2 is generally cylindrical. However the support element 210 may assume other shapes or may be formed into a belt. In one example embodiment, the support element 210 may be formed from a conductive material, such as aluminum, iron, copper, gold, silver, etc. as well as alloys thereof. The surfaces of the support element 210 may be treated, such as by anodizing and/or sealing. In some example embodiment, the support element 210 may be formed from a polymeric material and coated with a conductive coating.

The charge generation layer 220 is designed for the photogeneration of charge carriers. The charge generation layer 220 may include a binder and a charge generation compound. The charge generation compound may be understood as any compound that may generate a charge carrier in response to light. In one example embodiment, the charge generation compound may comprise a pigment being dispersed evenly in one or more types of binders.

The charge transport layer 230 is designed to transport the generated charges. The charge transport layer 230 may include a binder and a charge transport compound. The charge transport compound may be understood as any compound that may contribute to surface charge retention in the dark and to charge transport under light exposure. In one example embodiment, the charge transport compounds may include organic materials capable of accepting and transporting charges.

In an example embodiment, the charge generation layer 220 and the charge transport layer 230 are configured to combine in a single layer. In such configuration, the charge generation compound and charge transport compound are mixed in a single layer.

The overcoat layer 240 is designed to protect the photoconductor drum 101 from wear and abrasion without altering the electrophotographic properties, thus extending the service life of the photoconductor drum 101. The overcoat layer 240 has a thickness of about 0.1 μm to about 10 μm. Specifically, the overcoat layer 240 has a thickness of about 1 μm to about 6 μm, and more specifically a thickness of about 3 μm to about 5 μm. The thickness of the overcoat layer 240 is kept at a range that will not provide adverse effect to the electrophotographic properties of the photoconductor drum 101.

In an example embodiment, the overcoat layer 240 includes a three-dimensional crosslinked structure formed from a curable composition. The curable composition includes a urethane resin having at least six radical polymerizable functional groups, and a charge transport molecule having at least one radical polymerizable functional group. The curable composition includes about 35 percent to about 65 percent by weight of the urethane resin having at least six crosslinkable functional groups, and about 35 percent to about 65 percent by weight of the charge transport molecule having at least one radical polymerizable functional group. In an example embodiment, the curable composition includes 50 percent by weight of the urethane resin having at least six radical polymerizable functional groups, and 50 percent by weight of the charge transport molecule having at least one radical polymerizable functional group. In terms of limitations, loading the urethane resin having at least six radical polymerizable functional groups at less than 35 percent by weight in the curable composition, may not provide sufficient crosslink density to give the overcoat layer 240 with abrasion resistance. Additionally, loading the urethane resin having at least six radical polymerizable functional groups at greater than 65 percent by weight in the curable composition may not provide the overcoat layer 240 with sufficient conductivity to give sufficient electrical properties for excellent image quality.

The at least six radical polymerizable functional groups of the urethane resin may be the same or different, and may be selected from the group consisting of acrylate, methacrylate, styrenic, allylic, vinylic, glycidyl ether, epoxy, or combinations thereof. A particularly useful urethane resin having at least six radical polymerizable functional groups includes a hexa-functional aromatic urethane acrylate resin, a hexa-functional aliphatic urethane acrylate resin, or combinations thereof.

In an example embodiment, the hexa-functional aromatic urethane acrylate resin has the following structure:

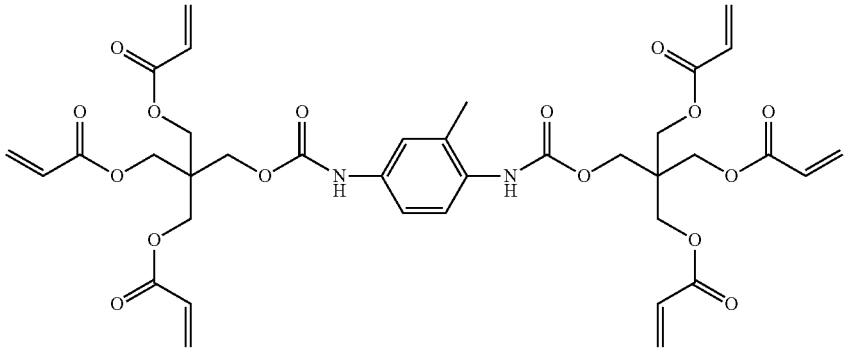

and is commercially available under the trade name CN975 manufactured by Sartomer Corporation, Exton, Pa.

In an example embodiment, the hexa-functional aliphatic urethane acrylate resin has the following structure:

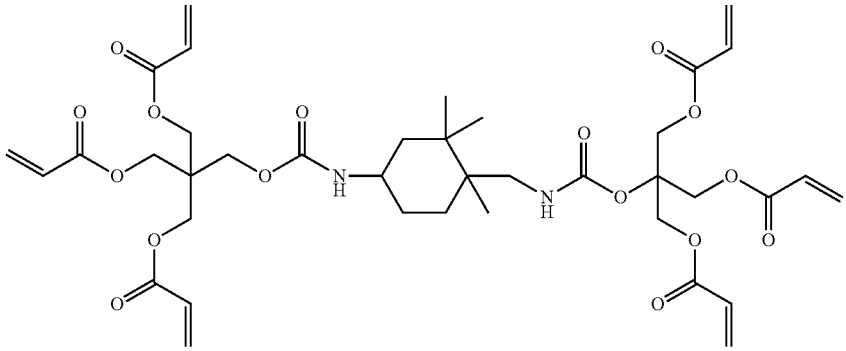

and is commercially available under the trade name EBECRYL® 8301 manufactured by Cytec Industries, Woodland Park, N.J.

Hexacoordinate urethane acrylates may also be synthesized using readily available starting materials, and well established synthetic methods. An example of the synthesis of hexacoordinate urethane acrylate is shown below.

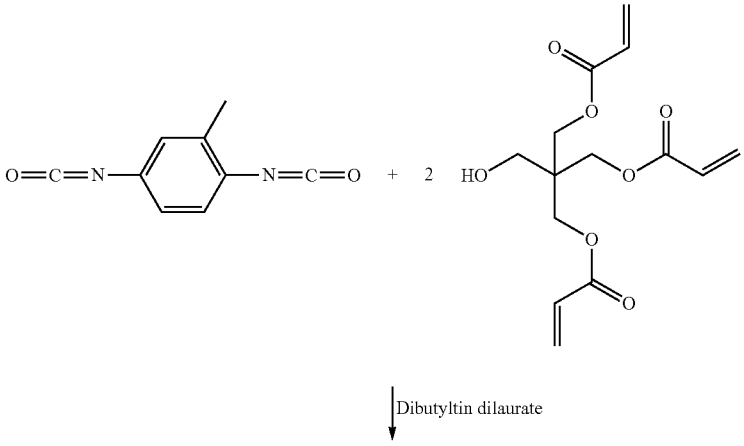

-continued

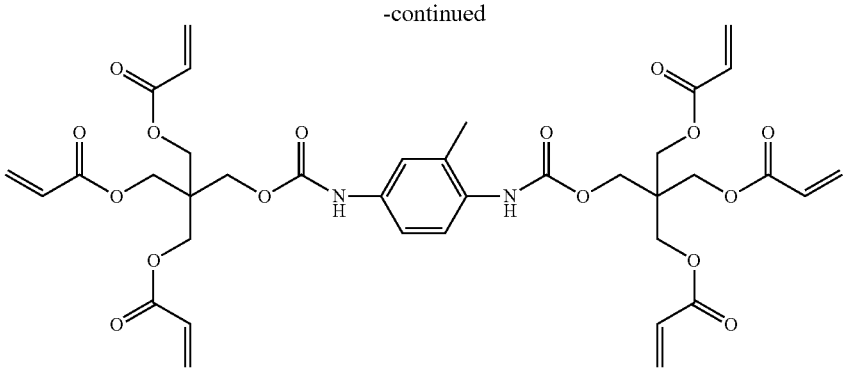

The urethane acrylate synthesis involves reaction of a diisocyanate with pentaerythritol triacrylate. In general, urethane acrylate chemistry involves reaction of an isocyanate with a hydroxy acrylate in the presence of a catalyst. The choice of isocyanate and/or hydroxy acrylate dictates the mechanical and thermal properties of the UV cured material. Curing of urethane acrylates, such as those described above, creates a 3-dimensionally crosslinked structure. Increasing the crosslink density of the UV cured material is one way to improve the mechanical and thermal properties of the materials. Urethane acrylates comprising at least six radical polymerizable functional groups are preferred since crosslink density increases with the number of radical polymerizable functional groups. High crosslink density is known to improve properties such as abrasion and chemical resistance. The crosslinked 3-dimensional network should be homogeneous throughout the cured material, since this improves mechanical and thermal properties. Homogeneous crosslinking is also important for applications requiring a high degree of optical transparency.

The urethane acrylate resin having at least six functional groups comprises the overcoat layer 240 with excellent abrasion resistance. These materials are most often used when a clear, thin, abrasion or impact resistant coating is required to protect an underlying structure. Consequently, urethane acrylates are most commonly deposited as thin films. Industrial applications include automotive and floor coatings with thicknesses ranging from tens to hundreds of microns. These overcoat applications on floor and automobiles, however, do not require a charge migration to occur. In an electrophotographic printer, such as a laser printer, an electrostatic image is created by illuminating a portion of the photoconductor surface in an image-wise manner. The wavelength of light used for this illumination is most typically matched to the absorption max of a charge generation material, such as titanylphthalocyanine. Absorption of light results in creation of an electron-hole pair. Under the influence of a strong electrical field, the electron and hole (radical cation) dissociate and migrate in a field-directed manner. Photoconductors operating in a negative charging manner moves holes to the surface and electrons to ground. The holes discharge the photoconductor surface, thus leading to creation of the latent image. Unfortunately, hexafunctional urethane acrylate resins lack any charge transporting properties, thus negatively limiting the thickness of the overcoat layer 240. The inventors have discovered that the addition of a particular charge transport molecules in combination with hexacoordinate urethane acrylates in the curable overcoat composition provides the overcoat layer 240 with electrical properties that approach those of the underlying charge transport layer 230. With the presence of charge transport molecules in the overcoat layer 240, the thickness of the overcoat layer 240 may be increased without having significant adverse effects on the electrical properties of the photoconductor drum 101. Ultimately this overcoat formulation of the present invention leads to a photoconductor drum having an 'ultra long life', thereby allowing a consumer to successfully print at least 100,000 pages on their printer before a replacement photoconductor drum has to be purchased.

The present invention describes a photoconductor overcoat layer comprising the unique combination of a urethane acrylate resin having at least six functional groups and a charge transport molecule having at least one radical polymerizable functional group. This combination provides both the abrasion resistance of the urethane acrylate and the charge transporting properties of the radical polymerizable charge transport molecule. Additionally, the overcoat of the present invention has (1) excellent adhesion to the photoconductor surface, (2) optical transparency and (3) provides a photoconductor drum that is resistant to cracking and crazing. Overcoat delamination or poor adhesion to the photoconductor surface has been noted as a problem in the prior art. Overcoat layers are typically coated in solvent systems designed to solubilize components of the overcoat formulation, while minimizing dissolution of the underlying photoconductor structure. Dissolution of components comprising the underlying photoconductor results in materials with no radical polymerizable functionality entering the overcoat layer. The result is dramatically lower crosslinking density and lower abrasion resistance since the properties of the overcoat layer are optimized by an uninterrupted 3-dimensional network. Ideally, the overcoat layer is distinct from the underlying photoconductor surface. However, the interface between the overcoat and the photoconductor surface often lacks the chemical interactions required for strong adhesion. The overcoat of the present invention have excellent adhesion to the photoconductor surface throughout the print life of the photoconductor. The overcoat must also be optically transparent. Illumination of the photoconductor in an image-wise manner requires that layers not involved in the charge generation process be transparent to the incident light. Additionally, optical transparency is an indicator of material and crosslink homogeneity within the overcoat structure. The overcoat of the present invention has a high degree of optical transparency throughout the print life of the photoconductor. The overcoat must also be crack free. UV cured films often exhibit cracks as a result of unrelieved internal stress. These cracks will manifest immediately in print, and will dramatically decrease the functional life of the overcoat. The overcoats of the present invention are crack free throughout the print life of the photoconductor.

The charge transport molecules having at least one radical polymerizable functional group may include the charge transport compounds incorporated in the charge transport layer 230. In an example embodiment, the charge transport molecules include tri-arylamine having at least one radical polymerizable functional group, tetraphenylbenzidine having at least one radical polymerizable functional group, or combinations thereof.

Suitable examples of tri-arylamine having at least one radical polymerizable functional group include monofunctional tri-arylamine having the following structures:

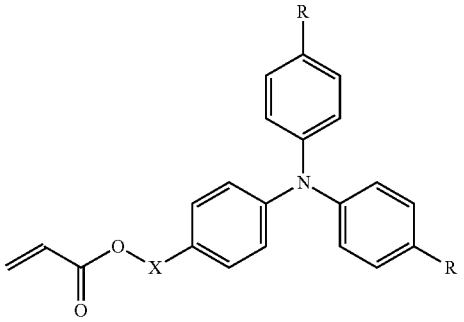

and

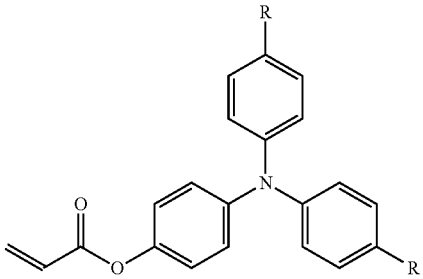

where R is —$CH_3$ or H; X is —$(CH_2)_n$— or —$(CH_2)_nO$—; and n is an integer ranging from 1 to 5.

Suitable examples of tri-arylamine having at least one radical polymerizable functional group include difunctional tri-arylamine having the following structures:

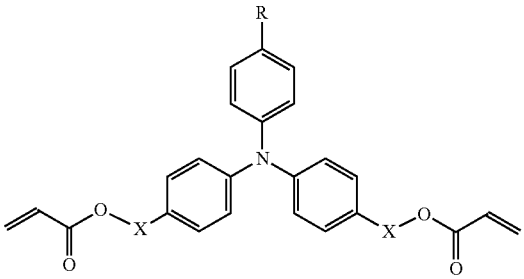

and

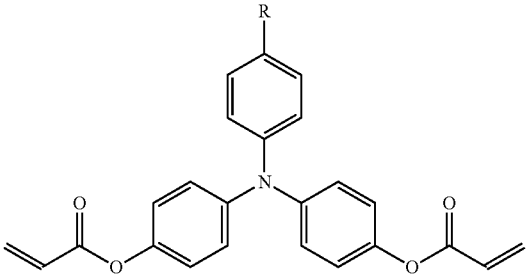

where R is —$CH_3$ or H; X is —$(CH_2)_n$— or —$(CH_2)_nO$—; and n is an integer ranging from 1 to 5.

Suitable examples of tri-arylamine having at least one radical polymerizable functional group include tri-functional tri-arylamine having the following structures:

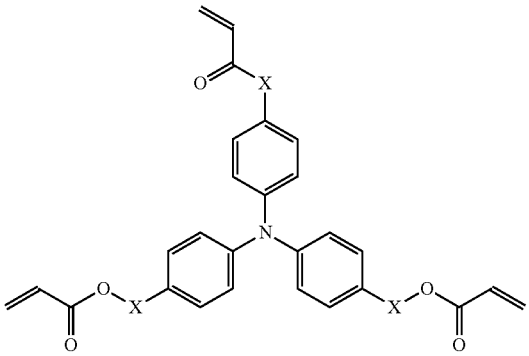

and

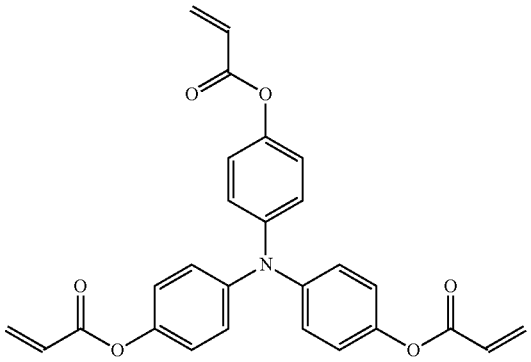

where R is —$CH_3$ or H; X is —$(CH_2)_n$— or —$(CH_2)_nO$—; and n is an integer ranging from 1 to 5.

Suitable examples of tetraphenylbenzidine having at least one radical polymerizable functional group include monofunctional tetraphenylbenzidine having the following structures:

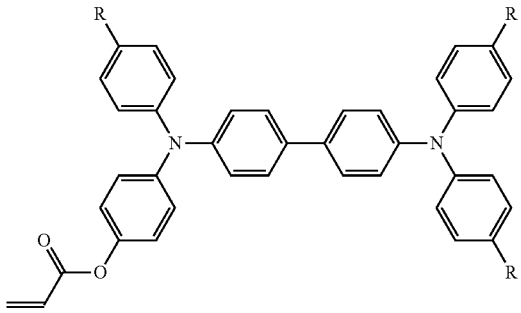

and

-continued

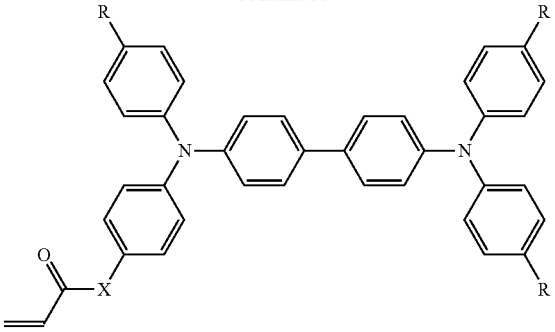

where R is —$CH_3$ or H; X is —$(CH_2)_n$— or —$(CH_2)_nO$—; and n is an integer ranging from 1 to 5.

Suitable examples of tetraphenylbenzidine having at least one radical polymerizable functional group include di-functional tetraphenylbenzidine having of the following structures:

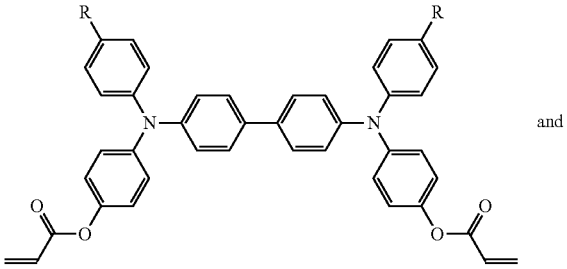

and

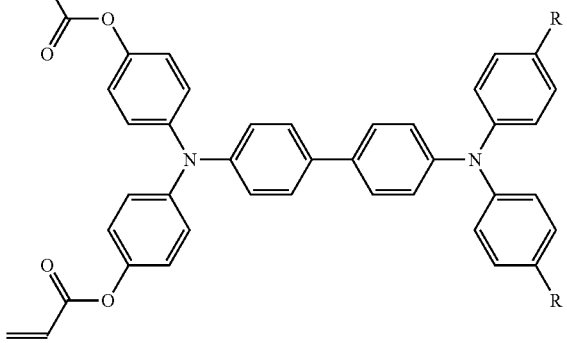

where R is —$CH_3$ or H; X is —$(CH_2)_n$— or —$(CH_2)_nO$—; and n is an integer ranging from 1 to 5.

Suitable examples of tetraphenylbenzidine having at least one radical polymerizable functional group include tetra-functional tetraphenylbenzidine having the following structures:

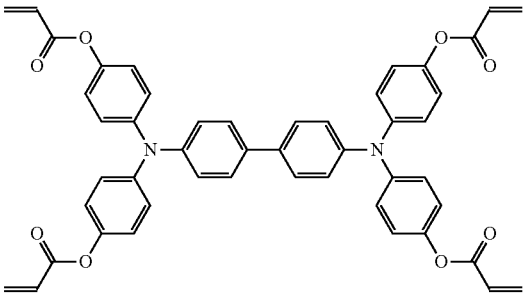

and

-continued

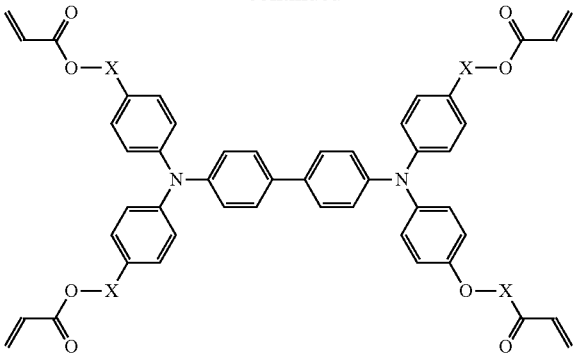

where R is —$CH_3$ or H; X is —$(H_2)_n$— or —$(CH_2)_nO$—; and n is an integer ranging from 1 to 5.

The curable composition may further include a monomer or oligomer having at most five radical polymerizable functional groups. The at most five radical polymerizable functional groups of the monomer or oligomer may be selected from the group consisting of acrylate, methacrylate, styrenic, allylic, vinylic, glycidyl ether, epoxy, or combinations thereof.

Suitable examples of mono-functional monomers or oligomers include, but are not limited to, methyl acrylate, methyl methacrylate, ethyl acrylate, ethyl methacrylate, propyl acrylate, propyl methacrylate, isobornyl acrylate, isobornyl methacrylate, 2-phenoxyethyl acrylate, and lauryl methacrylate.

Suitable examples of di-functional monomers or oligomers includes, but are not limited to, diacrylates and dimethacrylates, comprising 1,4-butanediol diacrylate, 1,4-butanediol dimethacrylate, ethylene glycol dimethacrylate, diethylene glycol diacrylate, diethylene glycol dimethacrylate, triethylene glycol diacrylate, triethylene glycol dimethacrylate, 1,3-butylene glycol diacrylate, 1,6-hexanediol diacrylate, 1,6-hexanediol dimethacrylate, 1,12-dodecanediol methacrylate, tripropylene glycol diacrylate, 1,3-butylene glycol dimethacrylate, 1,3-butylene glycol dimethacrylate, cyclohexane dimethanol diacrylate esters, or cyclohexane dimethanol dimethacrylate esters.

Suitable examples of tri-functional monomers or oligomers include, but are not limited to, trimethylolpropane triacrylate, trimethylolpropane trimethacrylate, hydroxypropyl acrylate-modified trimethylolpropane triacrylate, ethylene oxide-modified trimethylolpropane triacrylate, propylene oxide-modified trimethylolpropane triacrylate, and caprolactone-modified trimethylolpropane triacrylate.

Suitable examples pentafunctional monomers or oligomers include, but are not limited to, pentaerythritol tetraacrylate, ethoxylated pentaerythritol tetraacrylate, and di(trimethylolpropane)tetraacrylate.

Suitable examples pentafunctional monomer or oligomer include, but are not limited to, pentaacrylate esters, dipentaerythritol pentaacrylate esters, and melamine pentaacrylates.

The curable composition may further include a non-radical polymerizable additive such as a surfactant at an amount equal to or less than about 10 percent by weight of the curable composition. More specifically, the amount of non-radical polymerizable additive is about 0.1 to about 5 percent by weight of the curable composition. The non-radical polymerizable additive may improve coating uniformity of the curable composition.

Specific examples of photo initiators for use under UV cure conditions include acetone or ketal photo polymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl) ketone, 2-benzyl-2-dimethylamino-1-(4-molpholinophenyl) butanone-1,2-hydroxy-2-methyl-1-phenylpropane-1-one and 1-phenyl-1,2-propanedion-2-(o-ethoxycarbonyl)oxime; benzoinether photo polymerization initiators such as benzoin, benzoinmethylether, benzoinethylether, benzoinisobutylether and benzoinisopropylether; benzophenone photo polymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photo polymerization initiators such as 2-isopropylthioxanthone, 2-chlorothioxanthone, 2,4-dimethylthioxanthone, 2,4-diethylthioxanthone and 2,4-dichlorothioxanthone; phenylglyoxylate photoinitiators such as methylbenzoylformate and other photo polymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl) phenylphosphineoxide, bis(2,4-dimethoxybenzoyl)-2,4,4-trimethylpentylphosphineoxide, methylphenylglyoxyester, 9,10-phenanthrene, acridine compounds, triazine compounds and imidazole compounds. Further, a material having a photo polymerizing effect can be used alone or in combination with the above-mentioned photo polymerization initiators. Specific examples of the materials include triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone. These polymerization initiators can be used alone or in combination. The surface layer of the present invention preferably includes the polymerization initiators in an amount of 0.5 to 20 parts by weight and more specifically from 2 to 10 parts by weight per 100 parts by weight of the radical polymerizable compounds.

The curable composition is prepared by mixing the urethane resin and charge transport molecules in a solvent. The solvent may include organic solvent such as tetrahydrofuran (THF), toluene, alkanes such as hexane, butanone, cyclohexanone and alcohols. In one example embodiment, the solvent may include a mixture of two or more organic solvents to solubilize the urethane resin and radical polymerizable charge transport molecule while minimizing solubility of components within the underlying photoconductor structure. The curable composition may be coated on the outermost surface of the photoconductor drum 101 through dipping or spraying. If the curable composition is applied through dip coating, an alcohol is used as the solvent to minimize dissolution of the components of the charge transport layer 230. The alcohol solvent includes isopropanol, methanol, ethanol, butanol, or combinations thereof. In an example embodiment, the curable composition includes a photoinitiator.

The coated curable composition is then pre-baked to remove residual solvent, and exposed to ultraviolet light of sufficient energy to induce formation of free radicals to initiate the crosslinking. The exposed composition is then post-baked to anneal and relieve stresses in the coating.

Example 1

Photoconductor drums were formed using an aluminum substrate, a charge generation layer coated onto the aluminum substrate, and a charge transport layer coated on top of the charge generation layer.

The charge generation layer was prepared from a dispersion including type IV titanyl phthalocyanine, polyvinylbutyral, poly(methyl-phenyl)siloxane and polyhydroxystyrene at a weight ratio of 45:27.5:24.75:2.75 in a mixture of 2-butanone and cyclohexanone solvents. The polyvinylbutyral is available under the trade name BX-1 by Sekisui Chemical Co., Ltd. The charge generation dispersion was coated onto the aluminum substrate through dip coating and dried at 100° C. for 15 minutes to form the charge generation layer having a thickness of less than 1 μm, specifically a thickness of about 0.2 to about 0.3 μm.

The charge transport layer was prepared from a formulation including terphenyl diamine derivatives and polycarbonate at a weight ratio of 50:50 in a mixed solvent of THF and 1,4-dioxane. The charge transport formulation was coated on top of the charge generation layer and cured at 120° C. for 1 hour to form the charge transport layer having a thickness of about 17 μm to about 19 μm as measured by an eddy current tester.

Example 2

The overcoat layer was prepared from a formulation including 4,4'-di(acrylyloxypropyl)triphenylamine (2 g), EBECRYL 8301 (2 g) and methyl benzoylformate (MBF) photoinitiator (0.2 g) in a mixed solvent of isopropanol and THF. The weight ratio of isopropanol to THF in the mixed solvent was 90:10. The formulation was coated through dip coating on the outer surface of the photoconductor drum formed in Example 1. The coated layer was thermally cured at 60° C. for 5 minutes, then UV cured using Fusion UV H bulb for 5 seconds, and then thermally cured at 120° C. for 60 minutes. The cured layer forms the overcoat layer having a thickness of about 2.8 μm as measured by an eddy current tester. The overcoat thickness may be adjusted by either varying the amount of solvent, or changing the coat speed.

Example 3

The overcoat layer was prepared from a formulation including 4,4',4"-tri(acryloxypropyl)-triphenylamine (2 g), EBECRYL 8301 (2 g) and MBF photoinitiator (0.2 g) in a mixed solvent of isopropanol and THF. The weight ratio of isopropanol to THF in the mixed solvent was 90:10. The formulation was coated through dip coating on the outer surface of the photoconductor drum formed in Example 1. The coated layer was thermally cured at 60° C. for 10 minutes, then UV cured using Fusion UV H bulb for 5 seconds, and then thermally cured at 120° C. for 60 minutes. The cured layer forms the overcoat layer having a thickness of about 3.3 μm. as measured by an eddy current tester. The overcoat thickness may be adjusted by either varying the amount of solvent, or changing the coat speed.

Example 4

The overcoat layer was prepared from a formulation including EBECRYL 8301 (4 g) and MBF photoinitiator (0.2 g) in isopropanol solvent. The formulation was coated through dip coating on the outer surface of the photoconductor drum formed in Example 1. The coated layer was thermally cured at 60° C. for 10 minutes, then UV cured using Fusion UV H bulb for 5 seconds, and then thermally cured at 120° C. for 60 minutes. The cured layer forms the overcoat layer having a thickness of about 3.1 μm as measured by an eddy current tester. The overcoat thickness may be adjusted by either varying the amount of solvent, or changing the coat speed.

The photoconductor drums prepared in Examples 1, 2, 3 and 4 were installed in the electrophotographic image forming device. The electrophotographic image forming device was then operated at 50 ppm in a two-page and pause run mode. Wear rates, image print quality and discharge voltage for each of the installed photoconductor drums were then monitored. Results are presented in Table 1.

TABLE 1

| Photoconductor Drum | Overcoat Layer Thickness (μm) | Discharge Voltage | Wear rate, (μm/1000 pages) | Image print Quality |
|---|---|---|---|---|
| Example 1 (without overcoat layer) | — | — | 0.250 | Excellent |
| Example 2 | 2.8 | Unchanged | 0.010 | Excellent |
| Example 3 | 3.3 | Unchanged | 0.010 | Excellent |
| Example 4 | 3.0 | No Discharge | NA | NA |

As illustrated in Table 1, the photoconductor drum without the overcoat layer as prepared in Example 1 has a higher wear rate compared with that of the photoconductor drums with overcoat layer as prepared in Examples 2 and 3. The overcoat layer improves the abrasion wear resistance of the photoconductor drum. Without the overcoat layer, the charge transport layer of the photoconductor drum as prepared in Example 1 wears at a rate of about 0.250 μm/1000 pages. The overcoat layers of the photoconductor drums as prepared in Examples 2 and 3 have a reduced wear rate being about 0.010 μm/1000 pages.

The overcoat layers as prepared in Examples 2 and 3 have a negligible impact to the electrical properties of the photoconductor drum. Discharge voltage of photoconductor drums with overcoat layers as prepared in Example 2 and 3, remains unchanged compared to the discharge voltage of the photoconductor drum without overcoat layer as prepared in Example 1. By way of comparison, a photoconductor drum with a 3.1 μm overcoat layer prepared from the hexa-functional urethane acrylate EBECRYL 8301 in the absence of a radical polymerizable charge transport molecule (Example 4) has no functional electrostatic discharge and shows only spotty toner development.

Photoconductor drums having the overcoat layer as described in Examples 1, 2 and 3 have a high degree of optical transparency, show no coating cracks, and demonstrate excellent abrasion resistance. These overcoated photoconductor drums have electrical fatigue at the same range as that of non-overcoated photoconductor drums. Furthermore, these overcoated photoconductor drums provide prints having excellent uniformity and darkness level.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. An overcoat layer for an organic photoconductor drum, comprising an ultraviolet curable composition including:

about 35 percent to about 65 percent by weight of a urethane acrylate resin having at least six radical polymerizable functional groups, about 35 percent to about 65 percent by weight of a charge transport molecule having at least one radical polymerizable functional group, an organic solvent;

and a photoinitiator.

2. The overcoat layer of claim 1, wherein the urethane acrylate resin having at least six radical polymerizable functional groups is a hexa-functional aromatic urethane acrylate resin.

3. The overcoat layer of claim 1, wherein the urethane acrylate resin having at least six radical polymerizable functional groups is a hexa-functional aliphatic urethane acrylate resin.

4. The overcoat layer of claim 1, wherein the charge transport molecule comprises a tryarylamine having at least one radical polymerizable functional group.

5. The overcoat layer of claim 1, wherein the charge transport molecule comprises a tetraphenylbenzidine having at least one radical polymerizable functional group.

6. The overcoat layer of claim 1, wherein the curable composition further includes a monomer or oligomer having at most five radical polymerizable functional groups.

7. The overcoat layer of claim 1, wherein the curable composition further includes a non-radical polymerizable additive at an amount equal to or less than about 10 percent by weight of the curable composition.

8. The overcoat layer of claim 7, wherein the amount of non-radical polymerizable additive is about 0.1 to about 5 percent by weight of the curable composition.

9. The overcoat layer of claim 1, wherein a cured curable composition has a thickness of about 0.1 μm to about 10 μm.

10. An organic photoconductor drum comprising:

a support element;

a charge generation layer disposed over the support element;

a charge transport layer disposed over the charge generation layer; and a protective overcoat layer formed as an outermost layer of the organic photoconductor drum, the protective overcoat layer being formed from a curable composition including:

about 35 percent to about 65 percent by weight of a urethane acrylate resin having at least six radical polymerizable functional groups; and about 35 percent to about 65 percent by weight of a charge transport molecule having at least one radical polymerizable functional group.

11. The organic photoconductor drum of claim 10, wherein the urethane acrylate resin having at least six radical polymerizable functional groups is a hexa-functional aromatic urethane acrylate resin.

12. The organic photoconductor drum of claim 11, wherein the overcoat layer has a thickness of about 0.1 μm to about 10 μm.

13. The organic photoconductor drum of claim 10, wherein the urethane acrylate resin having at least six radical polymerizable functional groups is a hexa-functional aliphatic urethane acrylate resin.

14. The organic photoconductor drum of claim 10, wherein the charge transport molecule comprises a tryarylamine having at least one radical polymerizable functional group.

15. The organic photoconductor drum of claim 10, wherein the charge transport molecule comprises a tetraphenylbenzidine having at least one radical polymerizable functional group.

16. The organic photoconductor drum of claim 10, wherein the curable composition further includes a monomer or oligomer having at most five radical polymerizable functional groups.

17. The organic photoconductor drum of claim 10, wherein the curable composition further includes a non-radical polymerizable additive at an amount equal to or less than about 10 percent by weight of the curable composition.

18. The organic photoconductor drum of claim 17, wherein the amount of non-radical polymerizable additive is about 0.1 to about 5 percent by weight of the curable composition.

* * * * *